US012263396B2

(12) United States Patent
Andersson et al.

(10) Patent No.: US 12,263,396 B2
(45) Date of Patent: Apr. 1, 2025

(54) ICE SKATE WITH EXCHANGEABLE BLADE

(71) Applicant: FLOW MOTION TECHNOLOGY AB, Östersund (SE)

(72) Inventors: Fredrik Andersson, Undersåker (SE); Per Mårs, Ås (SE)

(73) Assignee: FLOW MOTION TECHNOLOGY AB, Östersund (SE)

( * ) Notice: Subject to any disclaimer, the term of this patent is extended or adjusted under 35 U.S.C. 154(b) by 0 days.

(21) Appl. No.: 18/028,681

(22) PCT Filed: Oct. 4, 2021

(86) PCT No.: PCT/EP2021/077264
§ 371 (c)(1),
(2) Date: Mar. 27, 2023

(87) PCT Pub. No.: WO2022/069761
PCT Pub. Date: Apr. 7, 2022

(65) Prior Publication Data

US 2023/0364492 A1 Nov. 16, 2023

(30) Foreign Application Priority Data

Oct. 2, 2020 (EP) ..... 20199754

(51) Int. Cl.
*A63C 1/28* (2006.01)
*A63C 1/30* (2006.01)

(52) U.S. Cl.
CPC ..... *A63C 1/28* (2013.01); *A63C 1/303* (2013.01); *A63C 2203/42* (2013.01)

(58) Field of Classification Search
CPC ..... A63C 1/00; A63C 1/28; A63C 1/303
See application file for complete search history.

(56) References Cited

U.S. PATENT DOCUMENTS 5,088,749 A 2/1992 Olivieri
5,123,664 A 6/1992 DeMars
5,257,793 A * 11/1993 Fortin ..... A63C 1/28 280/11.12
5,641,169 A 6/1997 Bekessy
5,988,683 A 11/1999 Venier et al.
(Continued)

FOREIGN PATENT DOCUMENTS

CA 2729250 C 12/2013
CA 2925636 C 11/2017
(Continued)

OTHER PUBLICATIONS

Extended European Search Report dated Mar. 22, 2021 for EP Application No. 20199753.3, 5 pages.
(Continued)

*Primary Examiner* — Brian L Swenson
(74) *Attorney, Agent, or Firm* — RMCK Law Group, PLC

(57) ABSTRACT

An ice skate for skating on ice, which comprises; an upper chassis section comprising a first contact surface having a front end and a rear end, a lower chassis section comprising a second contact surface having a front end and a rear end, and a coupling arrangement comprising a spring back means, which coupling arrangement is arranged to mechanically connect the upper and lower chassis sections.

18 Claims, 4 Drawing Sheets

(56) References Cited

U.S. PATENT DOCUMENTS

| | | | | |
|---|---|---|---|---|
| 6,113,111 | A | 9/2000 | Gierveld et al. | |
| 6,419,241 | B1 * | 7/2002 | Chenevert | A63C 17/18 280/11.18 |
| 7,758,053 | B2 * | 7/2010 | Wylie | A63C 1/32 280/11.18 |
| D631,120 | S | 1/2011 | Salmon | |
| 8,801,025 | B2 * | 8/2014 | Mars | A43B 5/0421 280/607 |
| 9,416,901 | B2 * | 8/2016 | Weber | F16L 25/01 |
| 9,693,600 | B1 | 7/2017 | Horne | |
| 11,071,903 | B2 * | 7/2021 | Labonte | A63C 1/303 |
| 2010/0109312 | A1 | 5/2010 | Salmon et al. | |
| 2011/0121527 | A1 * | 5/2011 | Salmon | A63C 1/303 280/11.12 |
| 2012/0187642 | A1 | 7/2012 | Corbeil et al. | |
| 2013/0285338 | A1 * | 10/2013 | Blois | A63C 1/30 29/446 |
| 2014/0015227 | A1 * | 1/2014 | Mars | A63C 9/02 280/611 |
| 2014/0062041 | A1 * | 3/2014 | Mars | A63C 1/28 280/11.15 |
| 2016/0114239 | A1 | 4/2016 | Davis et al. | |
| 2016/0193523 | A1 | 7/2016 | Gans et al. | |
| 2017/0259159 | A1 | 9/2017 | Chartrand et al. | |
| 2017/0361200 | A1 | 12/2017 | Chartrand et al. | |
| 2018/0117448 | A1 | 5/2018 | Labonte et al. | |
| 2018/0178108 | A1 | 6/2018 | Labonte et al. | |
| 2018/0185735 | A1 * | 7/2018 | Labonte | A63C 1/02 |

FOREIGN PATENT DOCUMENTS

| | | | |
|---|---|---|---|
| CA | 2935348 | A1 | 12/2017 |
| CA | 2947087 | A1 | 4/2018 |
| CH | 223321 | A | 9/1942 |
| EP | 2533867 | A1 | 12/2012 |
| EP | 2478937 | B1 | 12/2013 |
| EP | 2696949 | A1 | 2/2014 |
| EP | 2703053 | A1 | 3/2014 |
| WO | 0029076 | A1 | 5/2000 |
| WO | 2011099914 | A1 | 8/2011 |
| WO | 2012128690 | A1 | 9/2012 |

OTHER PUBLICATIONS

Extended European Search Report dated Mar. 23, 2021 for European Patent Application No. 20199754.1, 7 pages.

PCT International Search Report and Written Opinion dated Jan. 21, 2022 for International Application No. PCT/EP2021/077264, 13 pages.

PCT International Search Report and Written Opinion dated Jan. 28, 2022 for International Application No. PCT/EP2021/077269, 14 pages.

* cited by examiner

ICE SKATE WITH EXCHANGEABLE BLADE

CROSS-REFERENCE TO RELATED APPLICATIONS

This application is a 371 U.S. National Stage of International Application No. PCT/EP2021/077264, filed Oct. 4, 2021, which claims priority to European Patent Application No. 20199754.1, filed Oct. 2, 2020. The disclosures of each of the above applications are incorporated herein by reference in their entirety.

TECHNICAL FIELD

The present disclosure relates to the field of ice skates for skating on ice. In particular, the disclosure relates to an ice skate at which an upper chassis section is arranged to pivot by a rolling contact motion relative to a lower chassis section and wherein the lower chassis section may be removed and exchanged.

BACKGROUND

Traditional ice skates comprise a boot for receiving the foot of a user and a skate blade which is immovably fixed to the boot. The blade exhibits a certain profile or rocker which means that the lower ice contacting edge is curved with a certain radius of curvature along the longitudinal direction of the blade. This curvature allows the user to decide which portion of the blade that momentarily is to be in contact with the ice. By shifting the angle at which the force is transmitted from the user's leg to the blade, the user may move the momentary ice contacting portion back and force along the curved ice contacting surface.

Since longer momentary ice contacting portions promote higher speed on the ice, speed skates typically exhibit profiles with larger radiuses of curvature. In fact, at speed skates the entire ice contacting surface or at least a predominant portion thereof may be straight without any curvature at all. On the other hand, shorter momentary ice contacting portions promote the manoeuvrability and facilitates sharp turns, quick starts and stops as well as backward skating. For this reason, ice skates for use at other sports such as ice hockey, bandy, figure skating and the like typically exhibit blade profiles with smaller radiuses of curvature. The curvature of the blade may vary along the ice contacting surface such that the profile comprises a number of portions having different radiuses along the blade. Blades for ice hockey skates may e.g. exhibit a front portion with a smaller radius used for acceleration, a mid-portion with larger radius for gliding and high-speed skating and a rear portion with smaller radius for quick stops and cross-over skating.

For speed skates there exists different types of so-called clap-bindings for attaching the boot to the blade. Such clap-bindings allow the boot to pivot about a fixed axis of rotation relative to the blade. By this means the skater is allowed to extend each leg stroke while maintaining a comparatively long portion of the blade in contact with the ice, thereby to increase the speed.

Recently, a further developed type of ice skates has been introduced. At this type, the boot is allowed to pivot by a rolling contact motion in the longitudinal direction relative to the blade. EP 2 696 949 B1 discloses such an ice skate. This ice skate comprises a binding having an upper chassis section with a first contact surface and a lower chassis section with a second contact surface. At least one of the contact surfaces is curved. A coupling means is arranged to engage the upper and lower chassis sections such that they may pivot relative to another in the longitudinal direction and such that the first and second contact surfaces are in rolling contact without a fixed point of rotation during said pivoting. A spring back means is arranged to urge the relative pivotal position between the first and second contact surfaces to a neutral position. This ice skate is intended for use at ice hockey, bandy, figure skating and the like and it allows for that the user may shift the centre of gravity along the length of the foot while maintaining an even pressure to the blade. By this means the manoeuvrability, performance and comfort is greatly enhanced.

SUMMARY

One object of the present disclosure is to provide an enhanced ice skate of the type which allows an upper chassis section to pivot by a rolling contact motion without a fixed point of rotation relative to a lower chassis section.

Another object is to provide such an ice skate which allows easy exchange of the blade.

A further object is to provide such an ice skate which allows for precise adjustment of a spring back force which urges or biases the relative pivoting rolling motion to a neutral position.

A still further object is to provide such an ice skate which is simple and reliable in construction.

Yet another object is to provide such an ice skate exhibiting a reduced weight and dimensions.

Another object is to provide such an ice skate, which exhibits great stability and sturdiness.

A further object is to provide such an ice skate at which the geometry of the rolling contact motion readily may be altered.

These and other objects are achieved by an ice skate as defined in the amended claim 1. The ice skate for skating on ice, comprises; an upper chassis section comprising a first contact surface having a front end and a rear end, a lower chassis section comprising a second contact surface having a front end and a rear end, and a coupling arrangement comprising a spring back means, which coupling arrangement is arranged to mechanically connect the upper and lower chassis sections. At least one of the first and second contact surfaces is curved. The coupling arrangement is arranged to allow the upper chassis section to pivot relative to the lower chassis section by rolling contact motion between the first and second contact surface such that a momentary contact region of the first and second contact surfaces moves back and forth between the front and rear ends of the first and second contact surfaces. The spring back means is arranged to urge the momentary contact region to a neutral position along the first and second contact surfaces. The coupling means comprises a release means arranged to be selectively set to a locking position for applying the urging force between the first and second chassis sections and a release position for relieving the urging force and allowing the lower chassis section to be removed from the upper chassis section When utilizing and further developing the ice skate disclosed in EP 2 696 949 B1, it has been found that it is would be advantageous to be able to quickly remove and exchange the lower chassis section comprising the ice contacting blade of the ice skate. This applies e.g. at ice hockey and bandy matches where the blade tends to get worn or damaged during the match. Traditionally it has then been necessary to remove the entire ice skate from the player and to bring the skate to a blade sharpening station where the blade is sharpened and to thereafter re-fasten the ice skate to the player. Alternatively, one or more extra pairs of sharpened ice skates may be kept for each player, such that each player may change skates during the match when necessary. However, this is also a time-consuming process and requires considerable space for keeping the sharpened skates ready for use during the match.

The inventors have realized that it would be advantageous if it, as such situations, would be possible to provide the players with sharpened blades by merely exchanging a part of the ice skate, such that the boot of the skate may be kept fastened to the player's foot during the entire match. This would drastically reduce the time needed for providing each player with sharpened blades and would also considerably reduce the space needed for keeping the sharp blades. In particular, the inventors have realized that such a possibility to exchange only a part of the ice skate may advantageously be achieved by utilizing the coupling arrangement of the ice skate, which coupling arrangement is provided for allowing the relative pivotal movement between the upper chassis section and the lower chassis section. Utilizing the coupling arrangement both for allowing the relative pivotal movement and as a release means for allowing removal and re-attachment of the lower chassis section entails for that both functions may be accomplished in a reliable and space saving manner which requires only a comparatively low number of components.

According to an embodiment the release means may comprise the spring back means. In this way, the resiliency of the spring back means used for urging the momentary contact region to the neutral position is also used for accomplishing the releasable fixation of the lower chassis section to the upper chassis section. This further contributes to keeping the number of required components low and to reduce the required space.

The spring back means may be fixed to the upper chassis section and arranged to be selectively set to be engaged with the lower chassis section for urging the momentary contact region to the neutral position and to be disengaged from the lower chassis section, for allowing the lower chassis section to be removed from the upper chassis section.

The spring back means may comprise a first engagement surface and the lower chassis section may comprise an upwardly protruding engagement member with a second engagement surface. The first and second engagement surfaces are then engaged when the spring back means is set to be engaged with the lower chassis section.

The spring back means may be arranged in a front cavity of the upper chassis section and the engagement member may be receivable in the front cavity. Such a location of the spring back means affords for that the spring back means may be arranged inside an existing cavity of a front blade support member or a front post, which is arranged at the toe portion of modern, conventional ice skates, for the fixation and support of the blade. By this means, the advantageous blade exchange functionality may be integrated into the skate without any substantial deviation from the conventional dimensions and shape of modern ice skates. In particular, the spring back means may be incorporated at conventionally appearing skates with no increase of the outer dimensions or alteration of the outer shape.

The spring back means may be pivotal between an engagement position for engaging the lower chassis section and a disengagement position for being disengaged from the lower chassis section.

The release means may comprise a tool receiving means arranged to receive a tool for conversion of the release means between the locking position and the release position. This allows for that a comparatively strong force may be used for fixation of the lower chassis section since also such a strong force may conveniently be surpassed by the use of a tool.

The first and/or second contact surface may be arranged on an exchangeable insert which is removably fixed to the upper chassis section. This provides for easy and quick adaptation of the curvature if the first contact surface in order to meet individual user's personal preferences.

The ice skate may then further comprise an insert retention means arranged to releasably retain the insert to the upper chassis section when the lower chassis section has been removed. This prevents unintentional removal of the insert when the lower chassis section has been released e.g. when changing blades.

Such insert retention means may comprise press fitting means, snap fitting means or threaded screw means for the removable retention of the insert to the upper chassis section.

The spring back means may comprise a link mechanism comprising a first link arm which is pivotally connected to the upper chassis section, a second link arm which is pivotally connected to the first pivot arm and a spring arranged to urge respective free ends of the first and second pivot arm towards each other. This affords for a reliant, durable and space saving means to achieve the force for urging the momentary contact region to the neutral position and for allowing easy release of the lower chassis section.

The curvature of the first and/or second contact surface may exhibit a constant radius over its entire length.

Alternatively, at some applications it may be desirable that the curvature of the first and/or second contact surface varies over its length.

At least a portion of the first and/or second contact surface may exhibit a constant curvature having a radius of >1 m, preferably 1-10 m, more preferably 2-8 m and most preferably 3-7 m.

At least a portion of the first and/or second contact surface may exhibit curvature and length which are arranged such that the maximum pivot angle is between 0,5-5°, preferably between 1-3° and most preferably approx. 2°, when the contact region moves between the front and rear ends of the first and second contact surfaces.

Such curvatures and pivot angles have proven to be particularly suitable for ice skates used for ice hockey and bandy. It is believed that the same also applies to ice skates for figure skating.

The upper chassis section is preferably fixed to a boot for receiving the foot of a user and the lower chassis section preferably comprises a skate blade.

The upper chassis section may preferably be injection moulded from a polymer material.

According to one embodiment, the spring back means is arranged to urge the momentary contact region to a neutral position which is located at the front end of the first and second contact surfaces, and the spring back means is entirely arranged in front of the front ends of the first and second contact surfaces. With regard to the relative pivotal rolling motion between the upper and lower chassis sections it has been found that particularly advantageous properties are achieved if the spring back means is arranged to urge the momentary contact region to a neutral position which is located at the front end of the two contact surfaces. Hence, certain advantages are achieved if the ice skate is arranged such the user may preform only a backward rolling from the neutral position, towards which the spring back means urges the momentary contact region. By this means the user may apply the force from the leg directly to the front portion of the blade without any intermediate resiliency or play. Hereby the power applied to the front portion of the blade during the push off phase of the skate is transferred to the ice without any substantial loss such that the power efficiency is increased, e.g. during acceleration. Naturally, this affords for a great advantage since the increased power efficiency allows for higher skating speed and/or reduced fatigue of the skater. The direct, non-elastic transfer of force to the front portion of the blade also enhances the skater's control and precision of the skate, especially during acceleration.

Additionally, an arrangement of the spring back means entirely in front of the contact surfaces provides for that the length of the lever by which the spring back means urges the momentary contact region towards the neutral position is increased. Hereby, the active urging force is increased such that the spring back means may be kept comparatively weak. This in turn reduces the total weight of the ice skate which is greatly advantageous at many applications, such as at ice hockey skates. The increased length of the lever also affords for that the active urging force may be precisely fine-tuned to meet the specific needs and desires of different skaters.

The forward positioning of the spring back means also allows for that the spring back means may be formed in many different shapes and, particularly, that it may be given a simplistic a shape that is easy to manufacture.

The upper chassis section may comprise at least one first stop surface and the lower chassis section comprises at least one second stop surface, which stop surfaces are arranged to, when in mutual contact, prevent the momentary contact region to pass forward in front of the front ends of the first and second contact surface. Such cooperating first and second stop surfaces eliminate any resiliency from the sprig back means to interfere in the force transmission from the skater to the blade, when the momentary contact region has reached its frontmost position. The skater may thus rigidly apply the force to the toe portion of the blade, e.g. at push-off, which increases acceleration and enhances the precision and sense of the skating.

The first and second stop surfaces may preferably be arranged in front of the front ends of the first and second contact surface. By this means the rigidity to be applied at the frontmost rolling position may be accomplished in a simple, space saving and reliable manner.

The upper chassis section may comprise a plurality of first stop surfaces and the lower chassis section comprises the same number of second stop surfaces. Such multiple cooperating stop surfaces further assures the rigidity to be applied in the frontmost rolling position.

The upper chassis section may comprise at least one third stop surface and the lower chassis section then comprises at least one fourth stop surface, which stop surfaces are arranged to, when in mutual contact, prevent the rear portion of the lower chassis section to be separated from the upper chassis section.

The fourth stop surface may be arranged on an upwardly protruding second engagement member of the lower chassis section which second engagement member is receivable in a cavity of the upper chassis section and wherein the third stop surface is arranged in said cavity.

The spring back means may comprise an injection moulded spring of a polymer material. By this means the spring back means may readily be given the desired spring properties and dimensions and produced at low cost.

The spring back means may be arranged to be deformed when the momentary contact region moves from the neutral position and wherein the upper chassis section comprises a spring back limiting means which is arranged to limit the maximum deformation of the spring back means. By this, the spring back means is readily prevented from being broken or otherwise damages in case the upper and lower chassis sections are unintentionally separated from each other.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

Aspects and embodiments are now described, by way of example, with reference to the accompanying drawings, in which.

DETAILED DESCRIPTION

The aspects of the present disclosure will now be described more fully hereinafter with reference to the accompanying drawings, in which certain embodiments of the invention are shown.

These aspects may, however, be embodied in many different forms and should not be construed as limiting; rather, these embodiments are provided by way of example so that this disclosure will be thorough and complete, and to fully convey the scope of all aspects of invention to those skilled in the art. Like numbers refer to like elements throughout the description.

Figure 1:
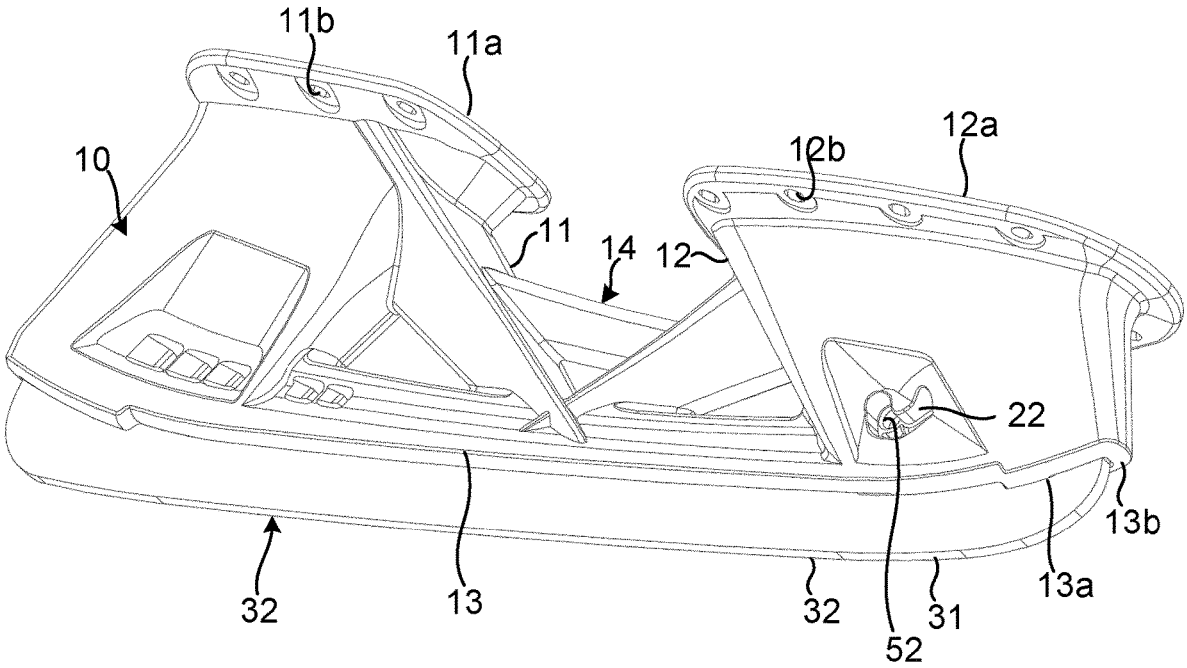
FIG. 1 is a perspective view illustrating an upper and a lower chassis section of an ice skate according to one embodiment.

FIG. 1 illustrates an upper chassis section 10 and a lower chassis section 30 of an ice skate according to an embodiment of the invention. The ice skate is intended for use at ice hockey playing. The upper chassis section 10 is arranged to be fixed to a boot (not shown) for receiving a foot of the user. The upper chassis section 10 constitutes a blade holder and is formed in one piece by injection moulding of a polymer material, such as polyamide. The upper chassis section is generally hollow and comprises a rear post 11, a front post 12 and a lower channel portion 13 which connects the rear 11 and front 12 posts. The channel portion 13 comprises two vertical channel walls 13*a*, 13*b* which extend longitudinally from the front end to the rear end of the upper chassis section 10. The channel walls 13*a*, 13*b* defines longitudinally extending channel for receiving an upper portion of the lower chassis section 30. The upper chassis section 10 further comprises a reinforcing portion 14 comprising a number of beams which interconnect the rear post 11, the front post 12 and the channel portion 13. The rear 11 and front 12 posts each has an upper flange portion 11*a*, 12*a* which projects laterally with through holes 1*ib*, 12*b* for support and fixation of the boot.

The lower chassis section 30 is made of steel and comprises a blade portion 31 with a lower ice contacting edge 32. By grinding the blade portion 31, it may be given any desired profile or rocker in order to suit each user's individual needs and preferences. Correspondingly, the edge 32 may be sharpened to any cross-sectional geometry which suits the ice and other conditions at hand as well as the user's personal preferences.

As best seen in FIGS. 1 and 2*a-c*, the lower chassis section 30 is formed as a single piece integral component. The lower chassis section may e.g. be formed by stamping, cutting or milling a metal blank. Preferably the lower chassis section 30 has a constant cross-sectional width which typically may be 2-5 mm and normally is approx. 3 mm.

The upper portion of the lower chassis section's 30 blade portion 31 is received in the channel formed between the channel walls 13*a*, 13*b*. For secure and steady guiding and sideways fixation of the lower chassis section 30, the lateral distance between the channel walls 13*a*, 13*b* is essentially equal to the cross-sectional width of the lower chassis section 30. The lower chassis section 30 further comprises a number of protrusions which extend upwardly, towards the upper chassis section 10 from the blade portion 31. These protrusions comprise a first engagement member in the form of a first hook member 33 which extends upwardly from the blade portion 31 and is received within a cavity 12*e* of the front post 12. A second engagement member in the form of a second hook member 34 extends upwardly from the rear end of the blade portion 31 and is received in a cavity 11*c* of the rear post 11.

The upper chassis portion 10 comprises a first curved contact surface 15 which exhibits a front end 15*a* and a rear end 15*b*. In the shown example, the first contact surface 15 is arranged as a lower edge of an exchangeable insert 16 which is removably received in a downwardly open insert cavity 17 of the upper chassis section 10. At a not shown alternative, the second contact surface may be arranged as a downwardly facing edge surface formed integral with the upper chassis section. The lower chassis section 3*o* exhibits a corresponding second contact surface 35 which extends along the upper edge of the blade portion 31 between a longitudinal mid region and a rear region of the lower chassis section 30. The second contact surface 35 exhibits a front end 35*a* which is vertically aligned with the front end 15*a* of the first contact surface 15 and a rear end 35*b*, which is vertically aligned with the rear end 15*a* of the first contact surface 15. The front ends 15*a*, 35*a* are arranged approximately at the longitudinal centre of the lower chassis section 30 and the rear ends 15*b*, 35*b* are arranged in proximity to the rear end of the lower chassis section 30. Typically, the length of the first 15 and second 35 contact surface, i.e. the distance between the front ends 15*a*, 35*a* and the rear ends 15*b*, 35*b* may constitute approx. half of the total length of the lower chassis section 30. For example, at an ice skate where the total length of the lower chassis section is 300 mm, the ice contacting edge of the blade portion may be 200 mm and the length of the first and second contact surfaces may be approx. 120 mm.

The first contact surface 15 is curved in the longitudinal direction. In the shown example the curvature is constant with a radius of approx. 4 m. However, the radius of curvature may be selected depending of e.g. the type of ice skate and the user's preferences. Additionally, the curvature needs not to be constant but may vary over the length of the contact surface.

By arranging the first contact surface 15 on an exchangeable insert 16, which is removably fixed to the upper chassis section 10, the ice skate may readily be adapted to the prevailing circumstances and the user's desires by easy exchange of the insert. At the shown example, the second contact surface 35 is planar over its entire length. However, the second contact surface may also be curved. At further alternative, not shown embodiments, the lower second contact surface may be curved and the upper first contact surface may be planar.

Figure 2A:
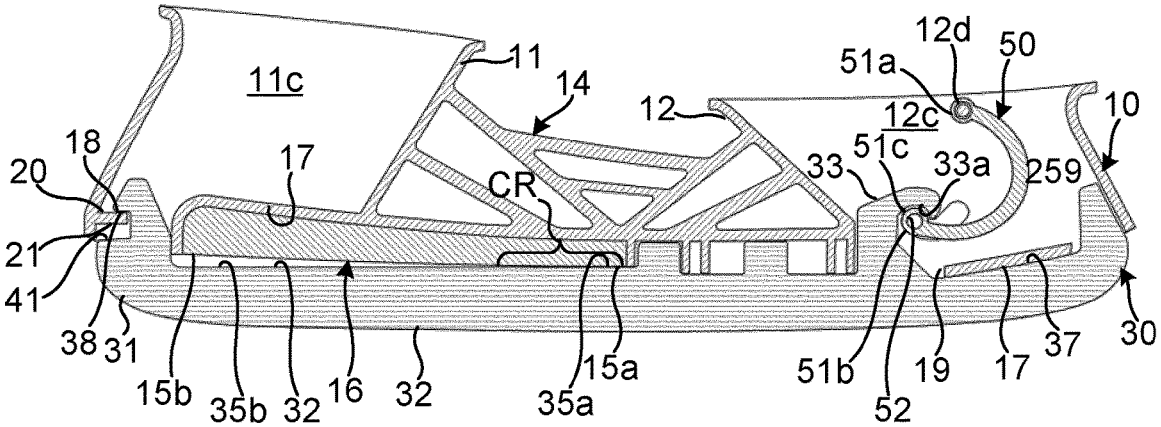
FIGS. 2*a-c* are longitudinal sections through the ice skate shown in FIG. 1 illustrating respective states of a spring back means.

In any case, the first 15 and second 35 contact surfaces, at least one of which is curved, allows for that the upper chassis section 10 may pivot by a rolling contact motion without a fixed point of rotation relative to the lower chassis section 30. During such relative pivotal movement, a momentary contact region CR between the first 15 and second 35 contact surfaces will move back and forth between the front ends 15*a*, 16*a* and rear ends 15*b*, 16*b* of the first 15 and second 35 contact surface. In FIG. 2*a* the upper chassis section 10 has been pivoted forwardly to its frontmost position whereby the momentary contact region CR is positioned at the front ends 15*a*, 35*a* of the first 15 and second 35 contact surfaces. Correspondingly, In FIG. 2*b* the upper chassis section 10 has been pivoted rearwardly to its rearmost position, whereby the momentary contact region CR is positioned at the rear ends 15*b*, 35*b* of the first 15 and second 35 contact surfaces.

Figure 2B:
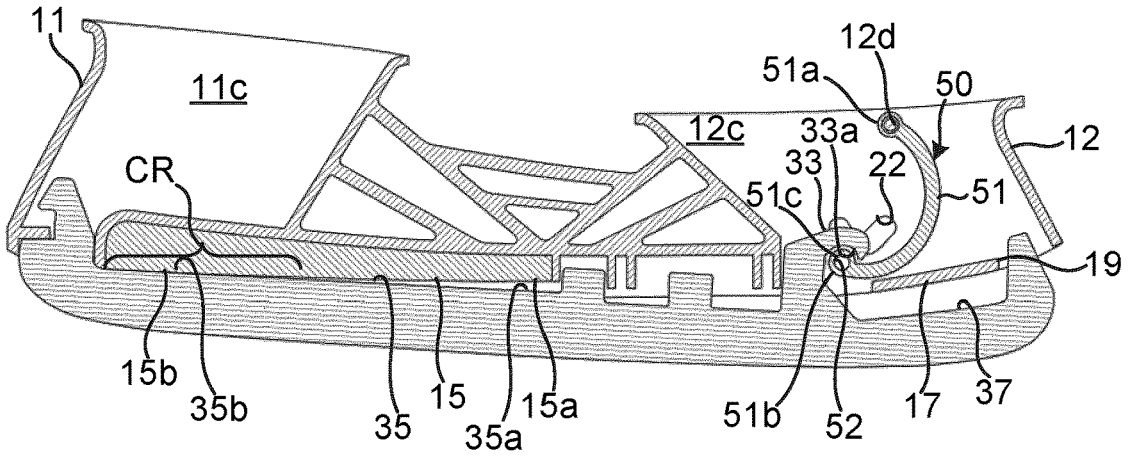

The ice skate further comprises a coupling arrangement which connects the upper 10 and lower 30 chassis sections while allowing said relative pivotal movement. The coupling arrangement comprises a spring back means 50 which is arranged to resiliently urge the relative pivotal movement forwardly to a neutral position where the momentary contact region CR is located at the front ends 15*a*, 35*a* of the first 15 and second 35 contact surfaces. This neutral position is shown in FIG. 2*a*. By applying a force to the upper chassis section 10, behind the front ends 15*a*, 35 of the contact surfaces 15, 35, it is possible to temporarily pivot the upper chassis section 30 rearwardly such that the momentary contact region CR moves backwards towards the rear ends 15*b*, 35*b* as shown in FIG. 2*b*. A soon as such an external force is released, the spring back means 50 urges the relative movement back to the neutral position shown in FIG. 2*a*.

Figure 2C:
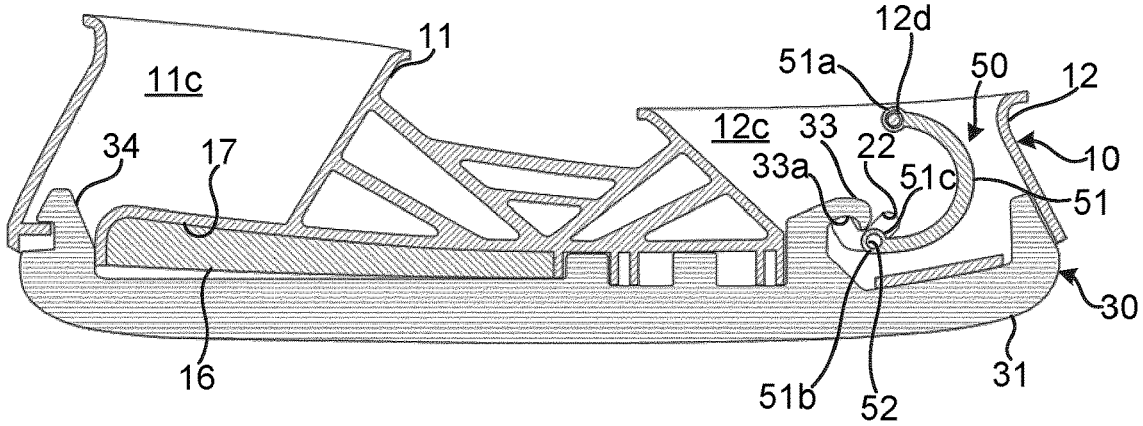

At the embodiment shown in FIGS. 2*a-c*, the spring back means 50 comprises a spring member 51 which is received in the cavity 12*c* of the upper chassis section's 10 front post 12. The spring member 51 is pivotally fixed to the front post 12 and it comprises a generally U-formed resilient arm. A first end 51*a* of the arm exhibits a circular through hole which receives a circular stem 12*d* extending laterally between opposing sidewalls of the front post 12, through the front post's cavity 12*c*. A second end 51*b* of the arm comprises a cylindrical portion with an outer first engagement surface 51*c* which is removably received in an engagement seat forming a second engagement surface 33*a* of the first hook member 33 of the lower chassis section 30. The cylindrical portion of the second end 51*b* further exhibits a lateral recess or through opening 52 for receiving a tool (not shown) as will be described further below.

In the position shown in FIG. 2*a* the spring member 51 has been initially pre-tensioned by being pivotally fixed to the stem 12*d* and brought into engagement with the engagement seat's second engagement surface 33*a*, such that it urges the relative pivotal movement between the upper 10 and lower 30 chassis sections to the neutral frontmost pivoted position. By applying a relative force between the upper 10 and lower 30 chassis sections, behind the front ends 15*a*, 25*a* of the contact surfaces 15, 35 the spring member will be deformed and further tensioned thereby to allow the backward pivotal movement to the position shown in FIG. 2*b*. At release of said force, the energy stored in the spring member 51 during the further tensioning causes a reversed pivotal movement back to the neutral position shown in FIG. 2*a*.

The upper chassis section 10 further comprises a first stop surface 17 which is formed on a lower laterally extending wall 19 connecting the side walls of the front post 12. The lower chassis section 30 exhibits a corresponding second stop surface 37 arranged on the upper edge of the blade portion 31 in the front region of the blade portion 31. The first 17 and second 37 stop surfaces are arranged to come in mutual contact when the momentary contact region CR has reached the front ends 15*a*, 35*a* of the contact surfaces 15, 35. Hereby, any further frontwards pivotal movement passed the neutral position is effectively prevented. The arrangement of the cooperating first 17 and second 37 stop surfaces allows for that any force applied to the upper chassis section 10, in front of the contact surfaces 15, 35 and at the neutral position will be directly and un-elastically transmitted to the blade portion 31 without any yielding.

The lower lateral wall 19 of the front post 12 also provides an arrest for the spring member 51. If for example the front portion of the lower chassis section 30 would be caught by or hooked up in a surrounding object such that said front portion runs the risk of being separated from the upper chassis section 10, the spring member 51 will make contact with the lower lateral wall 19 to thereby prevent further pivoting and extension of the spring member 51. By this means, the first engagement surface 51*c* on the second end 51*b* of the spring member 51 will maintain its engagement with the engagement seat's second engagement surface 33*a* of the lower chassis section's 30 first hook member 33, such that the front portion of the lower chassis section 30 is prevented from being unintentionally separated from the upper chassis section 10. The lower lateral wall portion 19 also prevents the spring member 51 from being excessively deformed and tensioned at such unintentional movement of the lower chassis section's front portion, thereby to reduce the risk fatigue failure of the spring member 51.

At the rear post 11, the upper chassis section 10 exhibits an upwardly facing third contact surface 18 which is arranged at a lower wall portion 20 extending laterally through the rear post cavity lie between opposite sidewalls and a rear wall of the rear post 11. A downwardly facing fourth stop surface 38 is arranged on the second hook member 34 of the lower chassis section. The third 18 and fourth 38 stop surfaces are arranged such that there exists a small distance therebetween when the first 17 and second 37 stop surface are in mutual contact and the relative pivotal movement thus is in the neutral position. Hence the third 18 and fourth 38 stop surfaces do not contribute to define the frontmost neutral position of the relative pivotal movement. Instead, the third 18 and fourth 38 stop surfaces are arranged for security purposes to prevent that the rear portion of the lower chassis section 30 is unintentionally separated from the upper chassis section 10 in case this rear blade portion is caught or hooked up to any surrounding object.

A downwardly facing fifth contact surface 21 is arranged on the lower side of the rear post's 11 lower wall portion 20 and a sixth stop surface 41 is arranged on the blade portion's 31 upper edge, behind the second hook member 34. The fifth 21 and sixth 41 stop surface come in mutual contact when, during backward pivoting, the momentary contact region CR reaches the rear ends 15*b*, 35*b* of the first 15 and second 35 contact surfaces, such that the pivotal movement is limited passed the rearmost pivotal position shown in FIG. 2*b*, where the momentary contact region is located at the rear ends 15*b* 35*b* of the contact surfaces 15, 35.

With reference to FIGS. 2*a* and 2*c*, the ice skate is further arranged to allow easy removal and exchange of the lower chassis section 30. Such exchange of the lower chassis section may be highly advantageous e.g. at ice hockey matches where it allows a worn or damaged blade to be quickly exchanged by a sharpened blade. For this purpose, the coupling arrangement comprises a release means as explained below.

At least one or both opposing lateral side walls of the front post 11 is provided with a generally V-shaped through penetrating slot 22. The slot 22 allows insertion of a pointed tool (not shown) into the recess or through opening 52 arranged at the second end 51*b* of the spring member 50. At the neutral position shown in FIG. 2*a*, the tool may be inserted into the recess or opening 52 and thereafter pulled forwards along the V-shaped slot 22 to thereby disengage the first engagement surface 51*c* of the spring member 51 from the second engagement surface 33*a* of the first hook member 33. FIG. 2*c* illustrates how the second end 51*b* of the spring member 51 in this way has been pulled forwardly, under anti-clockwise pivoting of the spring member 51 about the stem 12*d*, to an intermediate position. At this intermediate position the spring member 51 is released from the fist hook member 33, such that the front portion of the lower chassis section may be pulled out from the upper chassis section's 10 channel portion 13. Thereafter, continued removal of the lower chassis section's 30 front portion allows the second hook member 34 to be disengaged from the lower wall portion 20 of the rear post 12, such that the lower chassis section 30 may be completely separated from the upper chassis section 10.

For attaching the same or another lower chassis section, the second hook member 34 is first inserted in the channel portion 13 and engaged with the lower wall portion 20 of the rear post 11. Thereafter, the front portion of the lower chassis section 30 is pivoted into the front portion of the channel portion 13 such that the first hook member 33 is inserted into the front post 12. During this insertion the spring member 51 is allowed to pivot anti-clockwise such that its second end 51*b* does not interfere with the insertion of the first hook member 33. When the lower chassis section 30 has been inserted into the channel portion 13 of the upper chassis section 10, the tool may be inserted through the front portion of the V-shaped slot 22 to engage the recess or through opening 52 of the spring members 51 second end 51*b*. For completing fixation of the lower chassis section, the tool is then used to bring the second end's 51*b* first engagement surface 51*c* into engagement with the second engagement surface 33*a* of the first hook member 33. During this engaging operation, the spring member 51 is pivoted clockwise and pre-tensioned for assuring that the momentary contact region CR is securely urged towards the neutral position as described above.

When the lower chassis section 30 has been removed from the upper chassis section 10, the exchangeable insert 16 may readily be removed from the insert cavity 17. However, in order to prevent the insert 16 from unintentional removal from the insert cavity, e.g. when it is desired to exchange only the lower chassis section 30, the insert 16 and/or the insert cavity 17 may be provided with retention means for retaining the insert 16 from falling out from the cavity 17. In the shown example such releasable retention is accomplished by the insert 16 being lightly press fitted into the insert cavity 17. For removing the insert 16, a pointed tool (not shown) such as a screwdriver may be inserted between the insert 16 and a cavity wall and used for bending the insert out of the press fitted engagement with the cavity 17. At alternative, not shown, embodiments, the retention means may comprise snap-fit means threaded screw means or the like.

Figure 3:
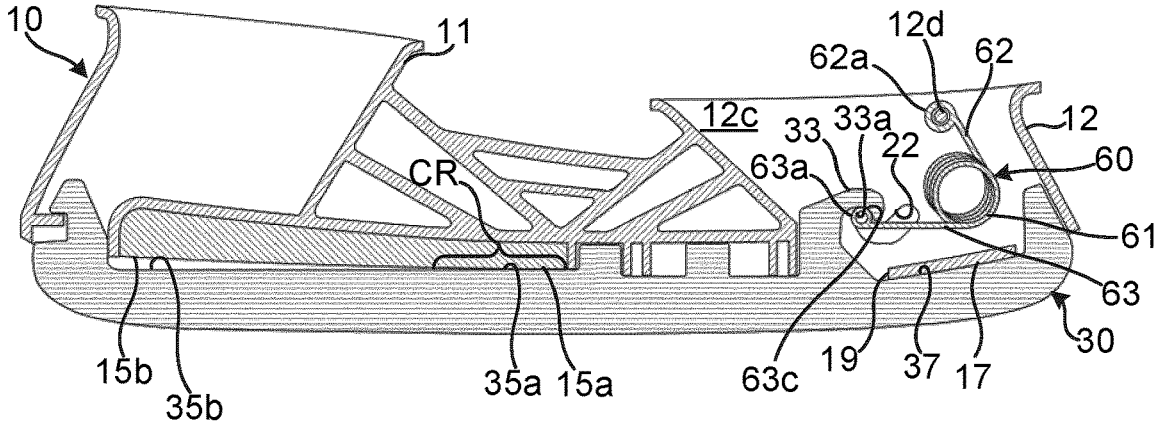
FIG. 3 is a longitudinal section corresponding to FIG. 2*a* illustrating another embodiment.

FIG. 3 illustrates another embodiment of the ice skate. At this embodiment the upper chassis section 10 and the lower chassis section 30 are essentially identical with the upper and lower chassis section described above and illustrated in FIGS. 1-2*c*. These components are therefore not described again here. However, at this embodiment the spring back means differs from the spring member 51 described above. Here the spring back means comprises a torsion spring 6*o* made of a spring steel wire and comprising a central coil 61. A first leg 62 having a first end 62*a* and a second leg 63 having a second end 63*a* extend from the central coil 61. The first end 61*a* exhibits a circular through hole which receives the lateral stem 12*d* of the upper chassis section's 10 front post 12, such that the torsion spring 60 is pivotally fixed to the front post 12 and received in the front post cavity 12*c*. By this means the torsional spring 60 is pivotally fixed to the front post 12 of the upper chassis section 10. The second end 63*a* comprises an annular loop with a first engagement surface 63*c* which may be received in the engagement seat's second engagement surface 33*a* of the lower chassis section's 30 first hook member 33. The annular loop also defines a inner through hole which may receive a tool (not shown) for moving the second end along the V-shaped slot 22 of the front post 12 when first engagement surface 63*c* is to be brought out from and into engagement with the second engagement surface 33*a* of the first hook member for releasing and attaching the lower chassis section 30 to the upper chassis section 10.

The torsion spring 60 functions in the same manner as the spring member 51 described above for urging the momentary contact region of the first 15 and second 35 contact surfaces to the front ends 15*a*, 35*a* and for allowing the lower chassis section 30 to be released and attached to the upper chassis section 10.

Figure 4:
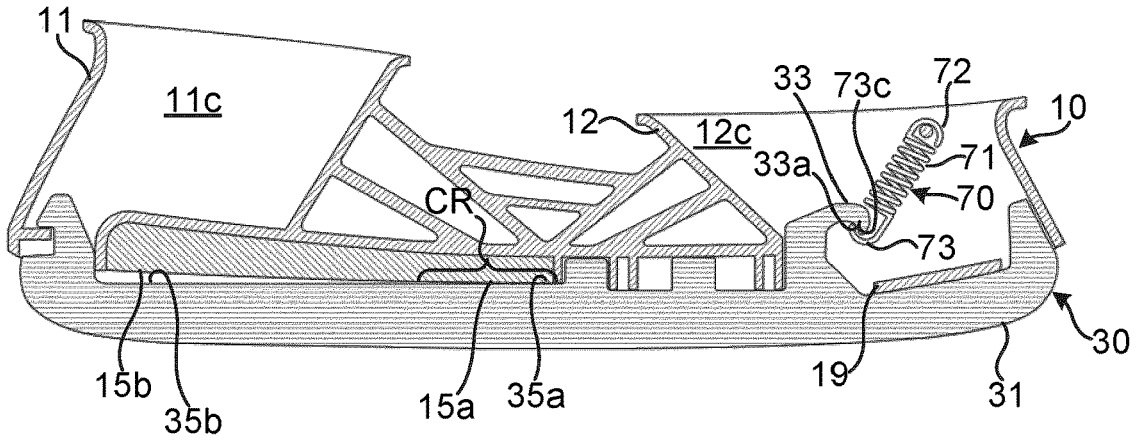
FIG. 4 is a longitudinal section corresponding to FIGS. 2*a* and 3 illustrating a further embodiment.

FIG. 4 illustrates a further embodiment of the ice skate. Also at this embodiment, the upper chassis section 10 and the lower chassis section 30 are essentially identical with the upper and lower chassis section described above and illustrated in FIGS. 1-2*c*. These components are therefore not described again here. At this embodiment the spring back means differs from the spring member 51 described above. Here the spring back means comprises a coiled expansion spring 70 made of a spring steel wire and comprising a central coil 71. A first hook 72 and a second hook 73 extend from respective ends of the central coil 71. The first hook 72 is hooked about the lateral stem 12*d* of the upper chassis section's 10 front post 12. The second hook 73 has a first engagement surface 73*c* which engages the second engagement surface 33*a* of the lower chassis section's 30 first hook member 33*a*.

The coiled expansion spring 70 functions in the same manner as the spring member 51 described above for urging the momentary contact region of the first 15 and second 35 contact surfaces to the front ends 15*a*, 35*a* and for allowing the lower chassis section 30 to be released and attached to the upper chassis section 10.

Figure 5A:
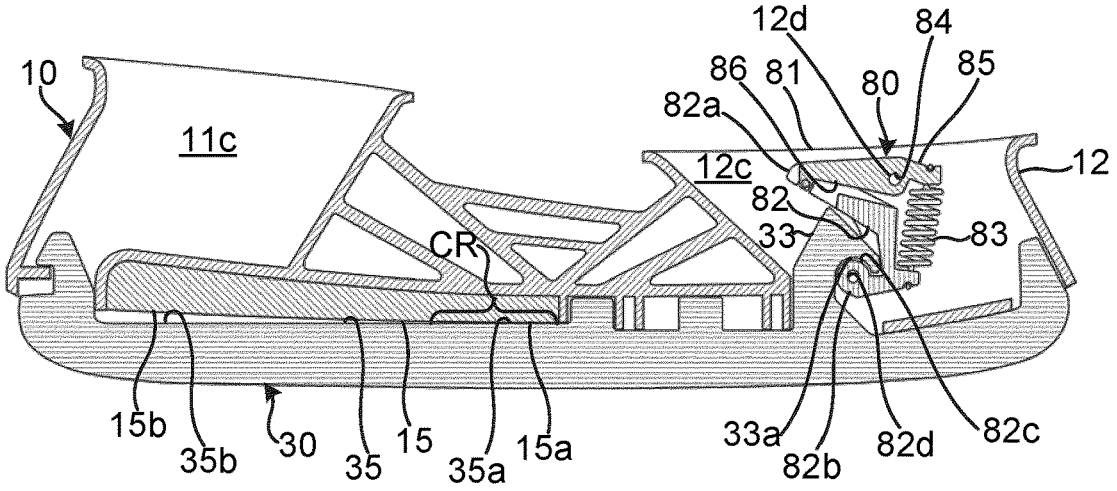
FIGS. 5*a-c* are longitudinal sections corresponding to FIGS. 2*a-c* illustrating a further embodiment.
Figure 5B:
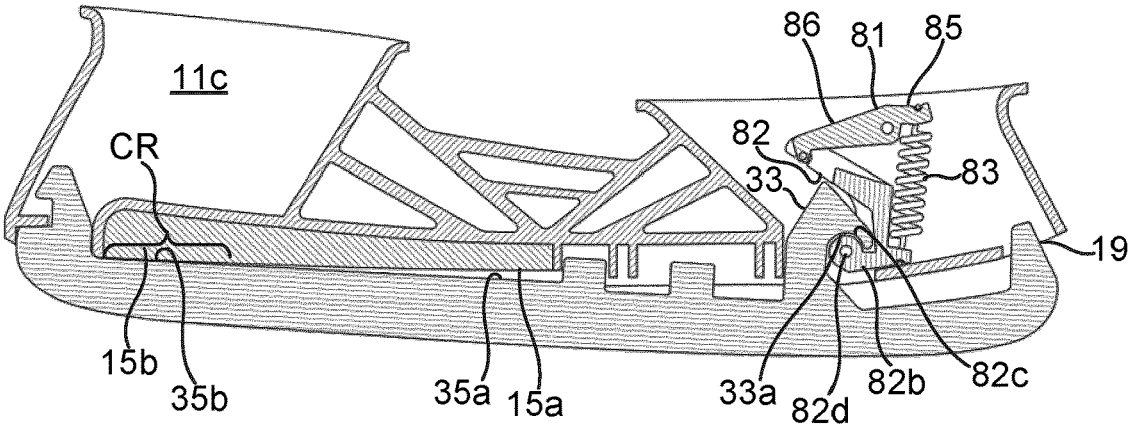
Figure 6:
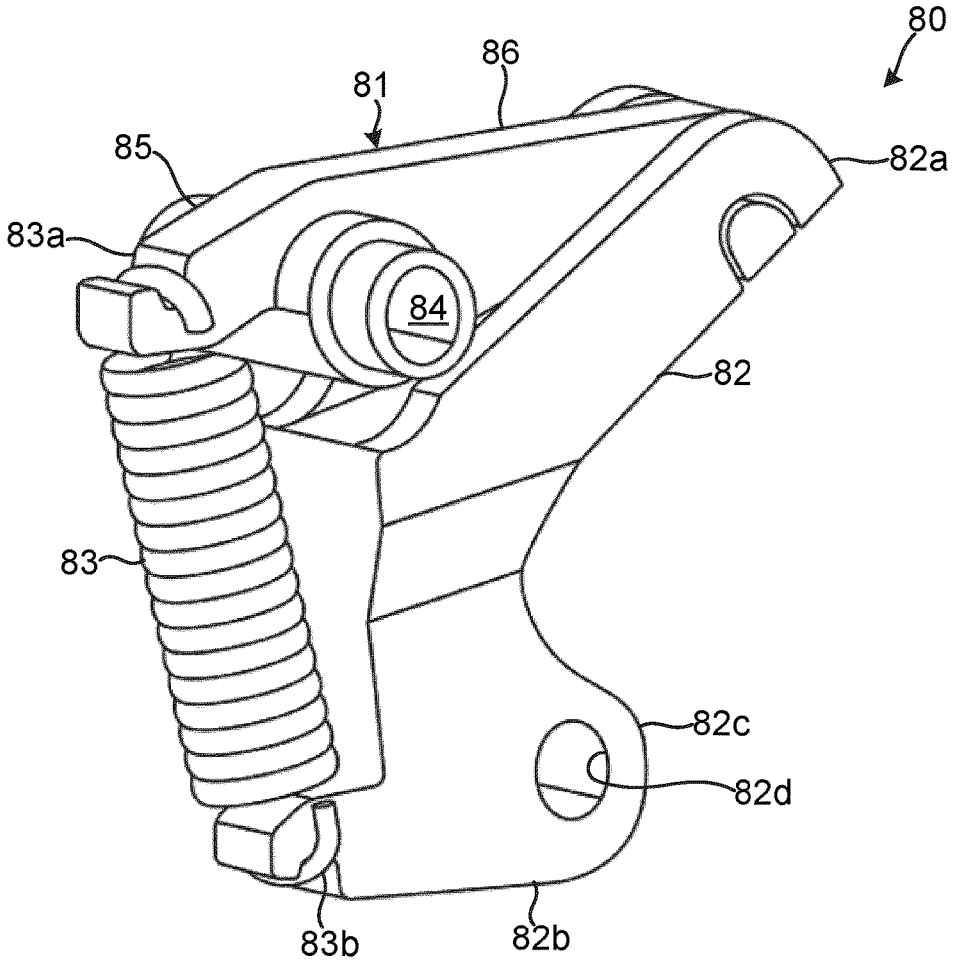
FIG. 6 is a perspective view illustrating a component shown in FIGS. 5*a-c* in enlarged scale.

FIGS. 5*a-b* and 6 illustrate yet another embodiment of the ice skate. Also at this embodiment, the upper chassis section 10 and the lower chassis section 30 are essentially identical with the upper and lower chassis section described above and illustrated in FIGS. 1-4. These components are therefore not described again here. At this embodiment the spring back means 80 differs from the spring members 51, 60, 70 described above. Here, the spring back means 80 comprises link mechanism which is received in the front post cavity 12*c* and which comprises a first link arm 81, a second link arm 82 and a coiled expansion spring 83. The first link arm 81 exhibits a circular through opening 84 which receives the stem 12*d* of the upper chassis section's front post 12, such that the first link arm 81 is pivotally fixed to the front post 12 of the upper chassis section 10.

The first arm 81 comprises a first lever portion 85 which extends forwardly and a second lever portion 86 which extends rearwardly from the through opening 8. A first end 82*a* of the second link arm 82 is pivotally connected to the free end of the second lever portion 86. The second end 82*b* of the second link arm 82 comprises a rounded portion with a first engagement surface 82*c* which is releasably received in the second engagement surface 33*a* of the first hook member 33 of the lower chassis section 30. The second end 82*b* further exhibits a lateral recess or through opening 82*d* for receiving a tool (not shown). The spring 83 comprises a first hooked end 83*a* which is connected to the first lever portion 85 of the fist link arm 81 and a second hooked end 83*b* which is connected to the second end 82*b* of the second pivot arm 82. By this means the spring 83 is arranged to urge the first lever portion 85 of the first pivot arm and the second end 82 of the second pivot arm 82 towards each other during relative pivotal movement about the pivotal connection between the first pivot arm's 81 second lever portion 86 and the second pivot arm's 82 first end 82*a*.

FIG. 5*a* illustrates how the link mechanism urges the momentary contact region CR to the neutral frontmost position, where the front end 15*a* of the first contact surface 15 and the front end 35*a* of the second contact surface 35 are in mutual contact. In FIG. 5*b* an external force has been applied to the upper chassis section 10, behind the front end 15*a*, of the first contact surface 15 such that the momentary contact region CR has been moved to the rearmost position where the rear ends 15*b*, 35*b* of the first 15 and second 35 contact surfaces are in mutual contact. At this and any intermediate position of the momentary contact region CR, the link mechanism urges, i.e. strives to return the monetary contact region CR to the neutral frontmost position shown in FIG. 5*a*. When the link mechanism has been extended to the position shown FIG. 5*b*, the second end 82*b* of the second pivot arm 82 makes contact with the lower transverse wall portion 19 of the front post 12 to thereby limit the movement of the second limit arm 82 and avoid over extension of the spring 81.

Figure 5C:
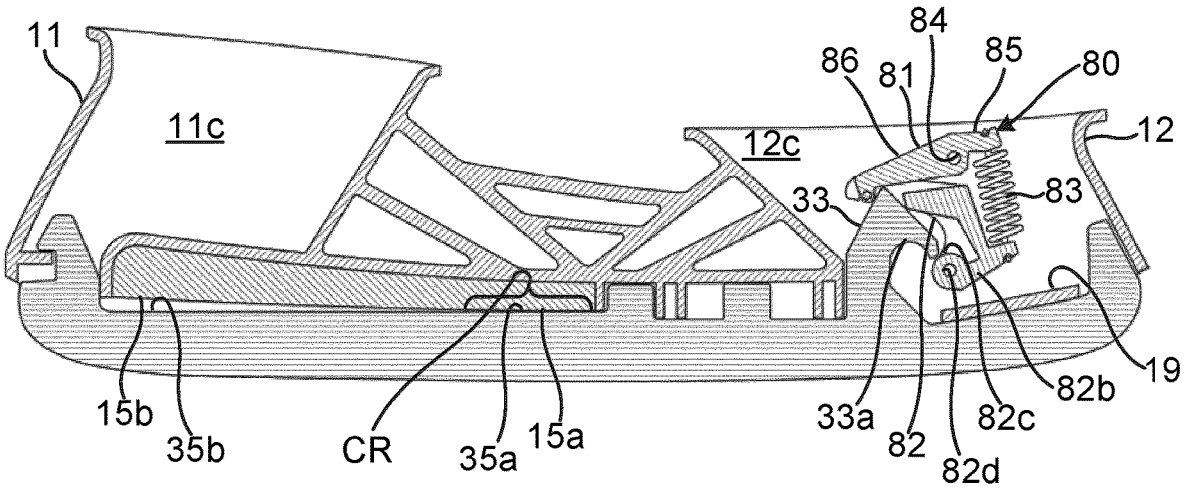

In FIG. 5*c* it is illustrated how a pointed tool (not shown) has been inserted into the through opening 82*d* of the link mechanism's second arm 82 and how the second end's 82*b* first engagement surface 82*c* has been brought out of engagement with the second engagement surface 33*a* of the lower chassis section's 30 first hook member 33 by pulling the tool forwardly. During this operation the pointed tool has been introduced into the front post cavity 12 through a non-shown slot arranged in one or two side walls of the front post 12. When the link mechanism by this means has been brought out of engagement from the lower chassis section 30 the lower chassis section 30 may readily be removed and exchanged as described above. After insertion of a new lower chassis section into the channel portion 18 the lower chassis section 30 is secured to the upper chassis section by using the pointed tool (not shown) for bringing the first engagement surface 82*c* of the second link arm 82 into engagement with the second engagement surface 33*a* of the lower chassis section's first hook member 33.

The aspects of the present disclosure have mainly been described above with reference to a few embodiments and examples thereof. However, as is readily appreciated by a person skilled in the art, other embodiments than the ones disclosed above are equally possible within the scope of the invention, as defined by the appended patent claims.

The invention claimed is:

1. An ice skate for skating on ice, which comprises;

an upper chassis section comprising a first contact surface having a front end and a rear end, a lower chassis section comprising a second contact surface having a front end and a rear end, and a coupling arrangement comprising a spring back means, which coupling arrangement is arranged to mechanically connect the upper and lower chassis sections, wherein at least one of the first and second contact surfaces is curved;

wherein the coupling arrangement is arranged to allow the upper chassis section to pivot relative to the lower chassis section by rolling contact motion between the first and second contact surface such that a momentary contact region (CR) of the first and second contact surfaces moves back and forth between the front and rear ends of the first and second contact surface, wherein the spring back means is arranged to apply an urging force between the upper and lower chassis sections for urging the momentary contact region (CR) to a neutral position along the first and second contact surfaces, wherein the coupling arrangement comprises a release means arranged to be selectively set to a locking position for applying the urging force between the upper and lower chassis sections and a release position for relieving the urging force and allowing the lower chassis section to be removed from the upper chassis section, wherein the release means comprises the spring back means, and wherein the spring back means is fixed to the upper chassis section and arranged to be selectively set to be engaged with the lower chassis section for urging the momentary contact region (CR) to the neutral position and to be disengaged from the lower chassis section, for allowing the lower chassis section to be removed from the upper chassis section.

2. An ice skate according to claim 1, wherein the spring back means comprises a first engagement surface and the lower chassis section comprises an upwardly protruding engagement member with a second engagement surface and wherein the first and second engagement surfaces are engaged when the spring back means is set to be engaged with the lower chassis section.

3. An ice skate according to 2, claim wherein the spring back means is arranged in a front cavity of the upper chassis section and wherein the engagement member is receivable in the front cavity.

4. An ice skate according to claim 1, wherein the spring back means is pivotal between an engagement position for engaging the lower chassis section and a disengagement position for being disengaged from the lower chassis section.

5. An ice skate according to claim 1, wherein the release means comprises a tool receiving means arranged to receive a tool for conversion of the release means between the locking position and the release position.

6. An ice skate according to claim 1, wherein the first and/or second contact surface is arranged on an exchangeable insert which is removably fixed to the upper chassis section.

7. An ice skate according to claim 6, further comprising an insert retention means arranged to releasably retain the insert to the upper chassis section when the lower chassis section has been removed.

8. An ice skate according to claim 1, wherein the spring back means comprises a first link arm which is pivotally connected to the upper chassis section, a second link arm which is pivotally connected to the first pivot arm and a spring arranged to urge respective free ends of the first and second pivot arm towards each other.

9. An ice skate according to claim 1, wherein the curvature of at least a portion of the first and/or second contact surface exhibits a radius of >1 meters.

10. An ice skate according to claim 1, wherein the curvature and the length of the first and/or second contact surface are arranged such that the maximum pivot angle is between 0.5-5° when the contact region (CR) moves between the front and rear ends of the first and second contact surfaces.

11. An ice skate according to claim 1, wherein the upper chassis section is fixed to a boot for receiving the foot of a user and the lower chassis section comprises a skate blade.

12. An ice skate according to claim 1, wherein the upper chassis section is injection moulded from a polymer material.

13. An ice skate according to claim 1, wherein the spring back means is arranged to urge the momentary contact region (CR) to a neutral position which is located at the front end of the first and second contact surfaces, and wherein the spring back means is entirely arranged in front of the front ends of the first and second contact surfaces.

14. An ice skate according to claim 1, wherein the curvature of at least a portion of the first and/or second contact surface exhibits a radius of 1-10 meters.

15. An ice skate according to claim 1, wherein the curvature of at least a portion of the first and/or second contact surface exhibits a radius of 2-8 meters.

16. An ice skate according to claim 1, wherein the curvature of at least a portion of the first and/or second contact surface exhibits a radius of 3-7 meters.

17. An ice skate according to claim 1, wherein the curvature and the length of the first and/or second contact surface are arranged such that the maximum pivot angle is between 1-3° when the contact region (CR) moves between the front and rear ends of the first and second contact surfaces.

18. An ice skate according to claim 1, wherein the curvature and the length of the first and/or second contact surface are arranged such that the maximum pivot angle is approximately 2° when the contact region (CR) moves between the front and rear ends of the first and second contact surfaces.

* * * * *